US007048571B2

(12) United States Patent
Wilinski

(10) Patent No.: US 7,048,571 B2
(45) Date of Patent: May 23, 2006

(54) ELECTRICAL TERMINAL

(75) Inventor: Bernd Wilinski, Lemgo (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 0 days.

(21) Appl. No.: 10/961,163

(22) Filed: Oct. 12, 2004

(65) Prior Publication Data

US 2005/0079753 A1 Apr. 14, 2005

(30) Foreign Application Priority Data

Oct. 9, 2003 (DE) ..... 103 47 668

(51) Int. Cl.
*H01R 11/20* (2006.01)

(52) U.S. Cl. ..... 439/409

(58) Field of Classification Search ..... 439/409, 439/410, 417, 408, 411
See application file for complete search history.

(56) References Cited

U.S. PATENT DOCUMENTS 4,729,738 A 3/1988 Heng et al.
6,863,558 B1 * 3/2005 Negishi et al. ..... 439/404
2002/0037670 A1 3/2002 Wilmes et al.

FOREIGN PATENT DOCUMENTS

DE 199 21 775 11/2000
DE 203 12 123 U1 11/2003

* cited by examiner

*Primary Examiner*—Phuong Dinh
(74) *Attorney, Agent, or Firm*—David S. Safran

(57) ABSTRACT

An electrical terminal has a housing including at least one side wall with two elongated holes, the two elongated holes are positioned spaced apart on a common circular path. The terminal also includes a busbar and at least two insulation piercing elements which produce electrical contact between the inserted conductor and the busbar. The electrical terminal includes at least two actuating elements arranged so as to turn relative to the insulation piercing elements in the electrical terminal. The actuating elements further includes two journals. Each journal is located in a corresponding one of the elongated holes and is restricted so that the actuating element, when pivoted out of a first position in which the insertion of an incoming conductor is possible into a second position in which the conductor makes contact with the insulation piercing element, is guided and restricted by the movement of the journals within the elongated holes.

13 Claims, 3 Drawing Sheets

ELECTRICAL TERMINAL

BACKGROUND OF THE INVENTION

1. Field of the Invention

The present invention relates generally to an electrical terminal having insulation piercing connection technology. More specifically, the present invention is directed to an electrical terminal for locking onto a mounting rail.

2. Description of Related Art

Electrical terminals, especially terminal blocks, have been known for decades and millions are used in the wiring of electrical systems and devices. The terminals are generally locked onto mounting rails which, for their part, are often located in a switchgear cabinet. The terminals are generally made as connecting terminals in that they have at least two conductor terminal elements which are electrically connected to one another via an electrically conducting connecting bar (i.e., a busbar). In addition to this basic type of terminal block, there are a host of different types of terminal blocks which are specially adapted based on each respective application for which the terminal block is used. For example, there are two-tier or three-tier terminals and three-conductor or four-conductor terminals which then each have a correspondingly larger number of conductor terminal elements.

In terminal blocks the conductor terminal elements are mainly screw terminals or tension spring terminals. The clamping principle in tension spring terminals is similar to that of screw technology. While in a screw terminal a tension sleeve pulls the conductor against the busbar by actuation of the terminal screw, in a tension spring terminal this task is assumed by the tension spring. To do this, the pretensioned tension spring is opened with an actuation tool (e.g., a screwdriver) so that the conductor can be inserted through a window in the leg of the tension spring into the connection space. After removing the actuating tool the conductor is pulled against the busbar by the spring force of the tension spring.

Both in the screw terminal and in the tension spring terminal, the electrical conductor must first be stripped after being cut to length, before contact-making of the electrical conductor can take place. Since special tools are required for stripping the electrical conductor, and since stripping takes a relatively large amount of time, for many years electrical terminals have been used, to which electrical conductors can be connected without prior stripping. To do this, the insulated conductor is inserted into a conductor receiver in the housing of the terminal and then pressed into an insulation piercing element, by which the insulation of the conductor is pierced and the core of the conductor makes contact with the insulation piercing element. In this regard, there are a host of possible embodiments of these terminals for connection of unstripped conductors. They differ especially in how the conductor, which has been inserted into the conductor receiver, is pressed into the insulation piercing element.

The initially described electrical terminal in insulation piercing technology is known, for example, from published German Patent Application DE 199 21 775 A1. In this known connecting terminal, the actuating elements are supported by means of relatively large, wheel-like guides in a rotary support which is formed by the side wall of the housing. Because the actuating elements are pivotally supported directly in the side wall of the housing, a maximum diameter is available for a conductor which is to be connected. Thus, for a given conductor cross section, the width of the electrical terminal can be chosen to be relatively small. The wheel-like guide of the actuating elements in the side wall however has the disadvantage that, as a result of the large wheel-like guides, the height of the electrical terminal is also relatively great. Moreover, due to the large, wheel-like guides, under certain circumstances, problems can arise in the adherence to the required creepage distances, Thus, insulation problems arise especially for higher currents.

SUMMARY OF THE INVENTION

Therefore, an object of this invention is to provide an electrical terminal in insulation piercing technology with a simple structure to ensure good and reliable handling, and moreover, a small installation size.

This object can be achieved by an electrical terminal in accordance with the present invention which has a housing that includes at least one side wall that has two elongated holes, the two elongated holes being spaced apart from one another on a common circular path. The terminal also includes a busbar and at least two insulation piercing elements. A conductor receiver can receive conductors to be connected where the insulation piercing elements produce electrical contact between the inserted conductor and the busbar. The electrical terminal includes at least two actuating elements arranged so as to turn relative to the insulation piercing elements in the electrical terminal. The actuating elements further includes two journals. Each journal is located in a corresponding one of the elongated holes and is restricted so that the actuating element, when pivoted out of a first position in which the insertion of an incoming conductor is possible into a second position in which the conductor makes contact with the insulation piercing element, is guided and restricted by the movement of the journals within the elongated holes.

By the interaction of the two journals with the two elongated holes, which are spaced apart from one another in the side wall of the housing, there arises not only a support of the actuating element during pivoting, as is the case in a normal rotary journal, but at the same time also limitation of the maximum possible rotation or tilting of the actuating element. In order to enable rotary motion of the actuating element upon pivoting of the actuating element out of the first position into the second position, the two elongated holes are arranged such that they lie on a common circular path and are spaced apart from one another. The center point of the circular path corresponds to the pivoting axis of the actuating element. Because one journal at a time is guided and restricted in one of the elongated holes, the guidance of the actuating element is especially reliable for pivoting out of the first position into the second position.

In addition to the guidance of the actuating element, by the interplay of the journals with the elongated holes, preferably a recess is made in the actuating elements and within the housing there are corresponding ribs. Upon pivoting of the actuating elements out of the first position (insertion position) into the second position (contact position), the ribs fit into the recesses in the actuating elements. Thus, additional guidance of the actuating element is achieved upon pivoting by the rib's fitting into the recess. The guidance of the actuating element can be further improved by a radial projection being formed on the end face of the actuating element above the recess and being supported on the rib when the actuating element is pivoted out of the insertion position into the contact position. In the above described preferred configuration of the electrical terminal, the support or guidance of the actuating element thus takes place both in the side wall and also in the interior of the housing. In this way, an especially reliable guidance of the actuating element is ensured so that even high connection forces are managed upon contact-making of conductors with a relatively large diameter.

It is especially advantageous when the above described rib is made and arranged within the housing such that the rib, while guiding the actuating element, simultaneously acts as tension relief for an inserted conductor. This is achieved so that, in the second position (contact position) of the actuating element, a conductor which has been inserted into the conductor receiver is clamped or fixed by the rib. By the corresponding dimensioning of the rib it can be ensured that when the conductor is clamped, only the insulation of the conductor, and not its core, is pressed in. This clamping of the connected electrical conductor ensures a "rest position" of the contact point of the electrical conductor and the core with the insulation piercing element. In this way, a problem in which as a result of tensile stresses on the electrical conductors slight relative motion occurs between the electrical conductor and the insulation piercing element which can lead to oxidation and high contact resistance is counteracted.

For simple handling of the electrical terminal, the actuating element according to one exemplary embodiment of the electrical terminal of the present invention, can be locked both in a first position in which the insertion of an incoming conductor is possible (insertion position) and also in the second position in which the conductor makes contact with the insulation piercing element (contact position). To do this, in the upper area of the actuating element on one face side, additional ribs are formed which form a catch with the top edge of the terminal. Thus, it is possible to fix the electrical terminal in the first position (the insertion position) upon delivery to the customer so that when individual electrical conductors are connected to a host of electrical terminals which are locked next to one another on a mounting rail, the respective conductors can be easily inserted into the respective conductor receivers by the electrician. The possibility of locking in the second position (the contact position) prevents the possibility of an electrical conductor, once connected, from being unintentionally pulled out of the electrical terminal again.

The desired small installation size of the electrical terminal is first of all achieved (with respect to the installation height) by the execution of a relatively small journal instead of the relatively large, wheel-like guides in the terminal known from published German Patent Application DE 199 21 775 A1. The installation width of the terminal of the invention can, on the one hand, be reduced in that for the especially preferred double guidance of the actuating element both by the journals and elongated holes and also by the ribs in conjunction with the recesses, the wall thickness of the side wall can be chosen to be very small. Moreover, the installation width can be further reduced by the conductor receiver which can be made as an elongated hole having an open lengthwise side. In this way, the width of the actuating element, and thus also the total width of the electrical terminal, can be reduced without reducing the maximum cross section of the conductor which is to be connected.

In particular, there are a host of possibilities for embodying and developing the electrical terminal in accordance with the invention. In this respect, reference is made to the detailed description below of one preferred embodiment in conjunction with the accompanying drawings.

DETAILED DESCRIPTION OF THE INVENTION

Figure 1:
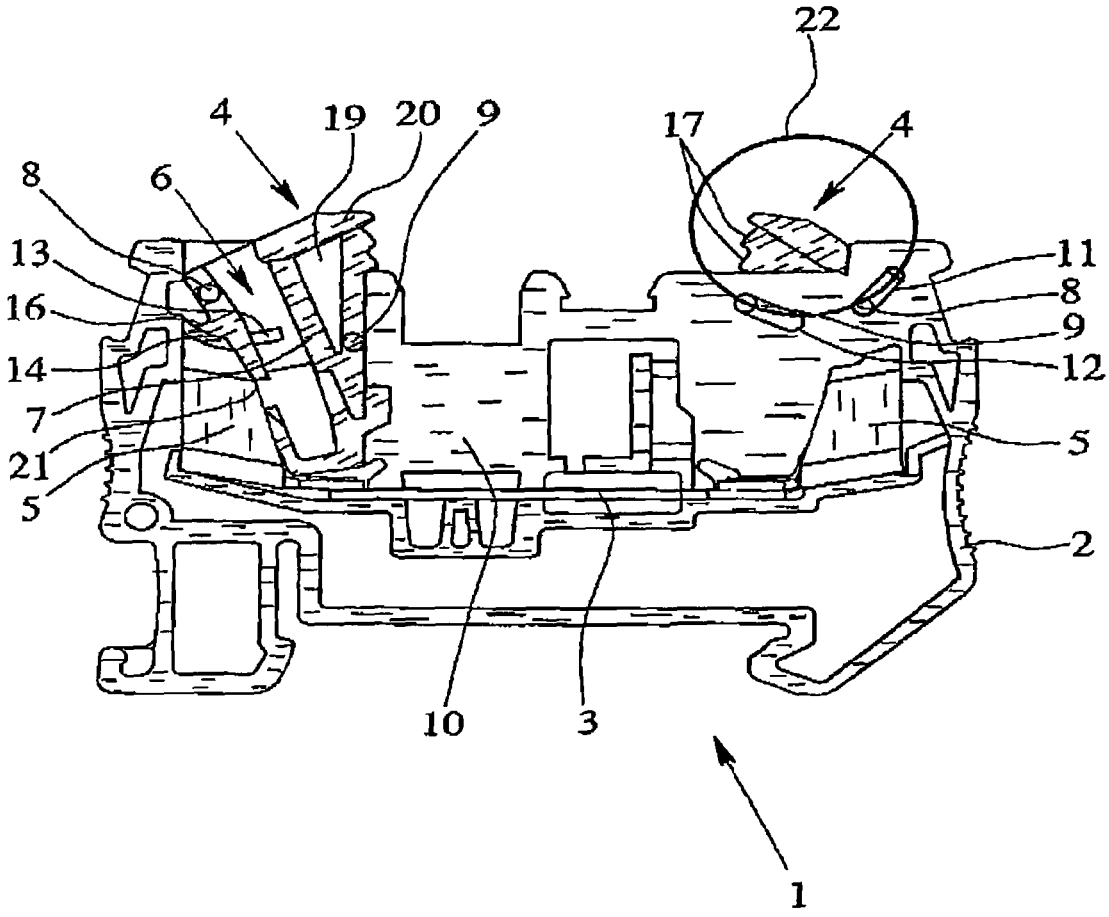
FIG. 1 is a perspective view of one embodiment of an electrical terminal in accordance with the present invention, with the side wall partially removed.
Figure 2:
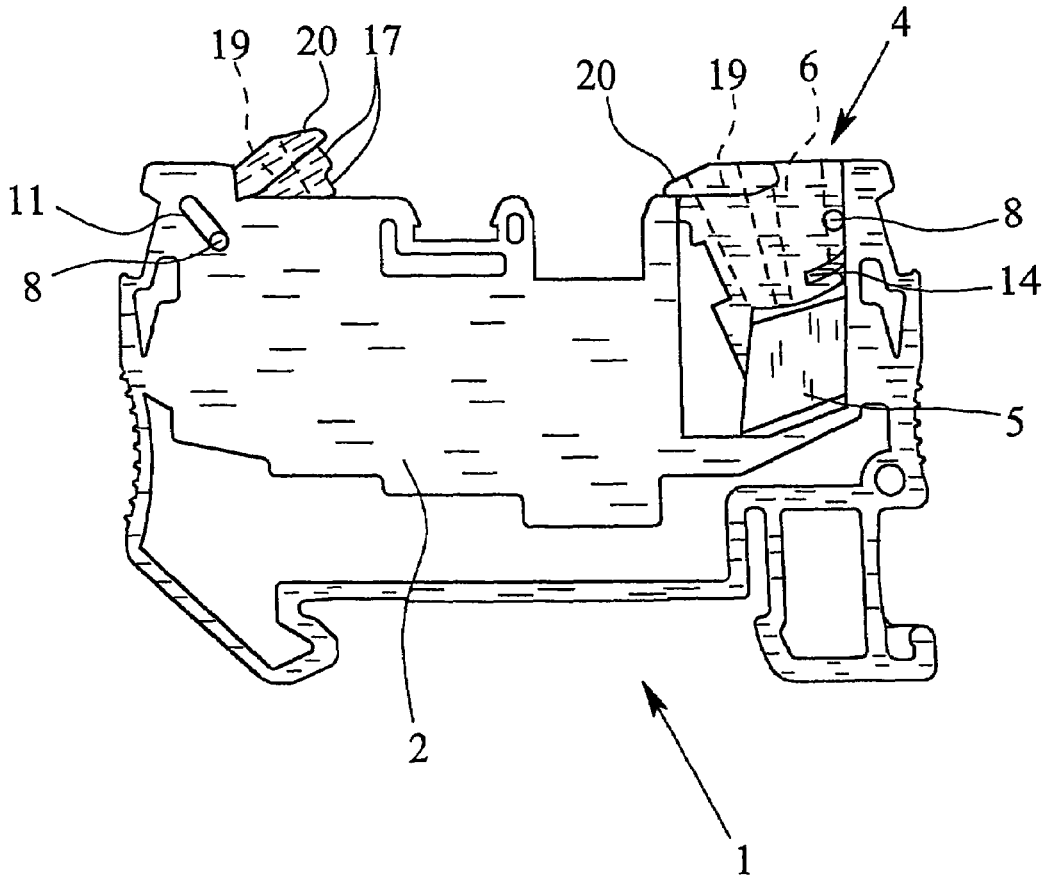
FIG. 2 shows the back of the electrical terminal as shown in FIG. 1, with the side wall partially removed.

The electrical terminal 1 shown in FIGS. 1 & 2 has a housing 2. In the figures, a connecting terminal for two conductors which are to be connected is shown. It goes without saying that the electrical terminal as provided by the present invention can also be made as a three-conductor or four-conductor connecting terminal. In the housing 2 of the electrical terminal 1, there is a busbar 3 and two actuating elements 4. In addition, the electrical terminal 1 has two insulation piercing elements 5 which are each connected to one another in an electrically conductive manner by the busbar 3.

The actuating elements 4 which each have one conductor receiver 6 for the conductors which are to be connected (not shown) are arranged to be able to turn relative to the insulation piercing elements 5 in the housing 2 of the electrical terminal 1 so that the actuating elements 4 can be pivoted out of a first position in which the insertion of an incoming conductor into the conductor receiver 6 is possible (insertion position), into a second position in which the conductors make contact with the insulation piercing elements 5 (contact position). In the electrical terminal 1 as shown in FIG. 2, the left actuating element 4 is in the insertion position, while the right actuating element 4 is in the contact position.

In the electrical terminal 1, on the side surface 7 of the actuating element 4, there are two journals 8, 9 and in the side wall 10 of the housing 2 two elongated holes 11 12 corresponding to the journals 8, 9 are formed. When the actuating element 4 is pivoted out of the first position in which the insertion of an incoming conductor into the conductor receiver 6 is possible (insertion position) and into the second position in which the conductor makes contact with the insulation piercing element 5 (contact position), the actuating element 4 is then guided by the movement of the journal 8, 9 in the elongated holes 11, 12, the pivoting motion being limited at the same time by the elongated holes 11, 12. The maximum possible angle or rotation of the actuating elements 4 is fixed by the length of the elongated holes 11, 12.

FIG. 1 shows that the two elongated holes 11, 12 are arranged in the side wall 10 of the housing 2 such that the lengthwise axes of the two elongated holes 11, 12 are roughly perpendicular to one another. This ensures especially good guidance of the actuating element 4 in the housing 2 of the electrical terminal 1. In order to enable rotary motion of the actuating element 4. upon pivoting of the actuating element 4 out of the first position into the second position, the two elongated holes 11, 22 are arranged such that they lie on a common circular path 21 and are spaced apart from one another. The center point of the circular path 21 corresponds to the pivoting axis of the actuating element 4, Because each journal 8, 9 is guided and restricted in a respective one of the elongated holes 11, 12, the guidance of the actuating element 4 is especially reliable for pivoting out of the first position into the second position.

The guidance or the support of the actuating element 4 in the housing 2 is further improved by forming a recess 13 in the actuating element 4 and by a corresponding rib 14 being located within the housing 2. When the actuating element is pivoted out of the insertion position (shown in the left side of the electrical terminal 1 shown in FIG. 1) into the contact position (shown in the right side of the electrical terminal 1 shown in FIG. 2) the rib 14 fits into the recess 13. The figures show that both the recess 13 and the rib 14 are made in the shape of an arc of a circle so that the pivoting motion of the actuating element 4 is not adversely affected by the interaction of the recess 13 and the rib 14. Rather, the actuating element 4 is also guided by the interaction of the recess 13 and the rib 14. This guidance can be further improved by a radial projection 16 in the form of a lug formed on the end face 15 on which the recess 13 is formed and being supported on the rib 14 when the actuating element 4 is pivoted into the contact position.

The above described rib 14 in interplay with the recess 13 is used not only for guidance of the actuating element 4, but simultaneously as tension relief for a conductor which has been inserted into the conductor receiver 6. This is achieved by the front edge of the rib 14 (when the actuating element 4 is in the contact position) projecting slightly into the conductor receiver 6, so that a connected conductor is clamped. This clamping of the connected electrical conductor results in a "rest position" of the contact point between the insulation piercing element 5 and the connected conductor. As shown in FIG. 1, the ribs 14 in the housing 2 are located a short distance above the insulation piercing elements 5. Thus, the desired tension relief is implemented as near as possible to the contact point of the inserted conductor with the insulation piercing element 5.

On the end face of the actuating element 4 in the upper area, additional ribs 17 are formed which together with the upper edge of the housing 2 form a two-stage catch. In this way, the actuating element 4 can be fixed both in the insertion position and in the contact position so that, on the one hand, it is possible to fix the electrical terminal 1 in the insertion position when delivered to the customer, and on the other hand, unintentional pivoting of the actuating element 4 back out of the contact position into the insertion position after making contact with the conductor which is to be connected, is prevented.

Figure 3:
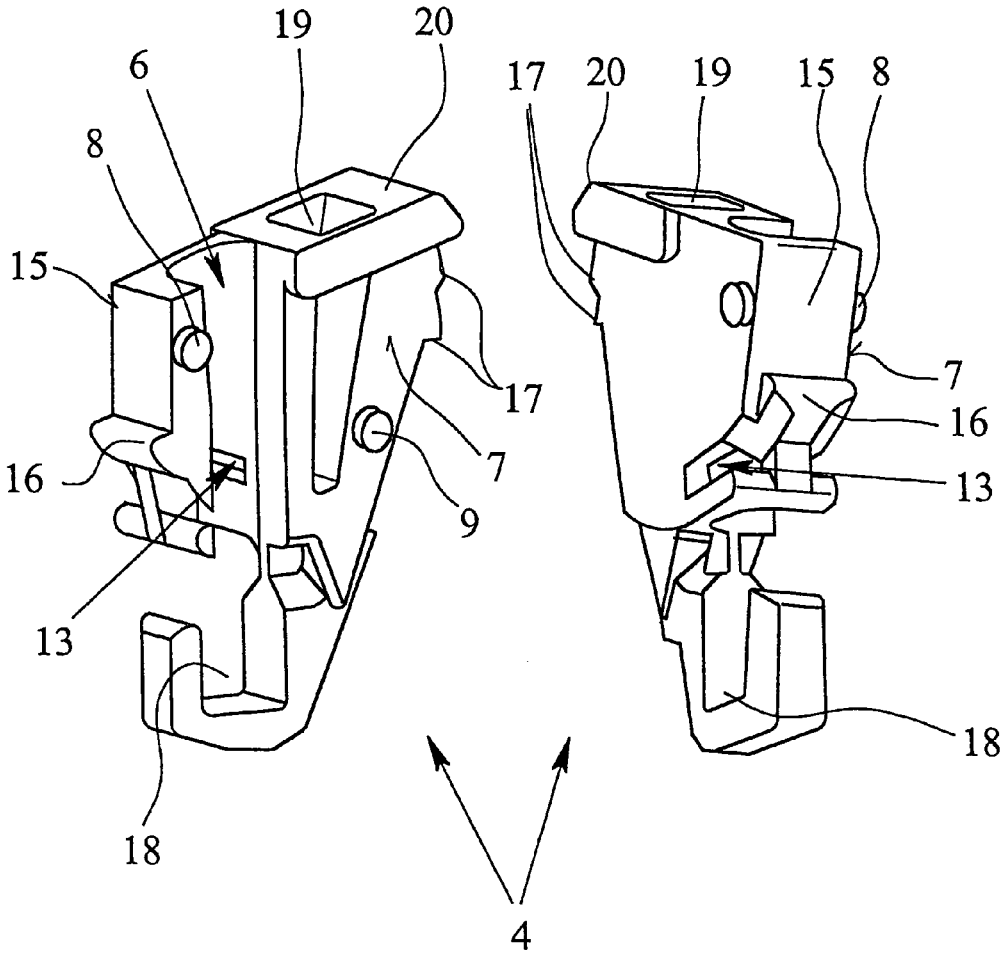
FIG. 3 shows an enlargement of the actuating element in two different positions.

FIG. 3 shows that the conductor receiver 6 is an elongated hole and extends into a receiving pocket 18. The receiving pocket 18, in the mourned state of the actuating element 4 in the electrical terminal 1, is located underneath the insulation piercing element 5. The receiving pocket 18 is used as a stop aid for the electrician when the conductor is being inserted into the conductor receiver 6. When the end of the conductor is inserted into the receiving pocket 18, it is ensured that when the actuating element 4 is pivoting into the contact position the conductor is properly grasped by a cutting portion 21 of the insulation piercing element 5 and thus electrical contact is made with the core of the conductor To further reduce the installation width of the electrical terminal 1, the conductor receiver 6 has an open lengthwise side, so that the width of the actuating element 4 can be reduced when the maximum cross section of a conductor which is to be connected is unchanged. Guidance of the conductor which is to be connected is then accomplished on this side by the side wall 10 of the housing 2.

For simple handling, in the actuating element 4 there is not only the conductor receiver 6, but also another receiver 19 for engaging an aid. The aid can be, for example, the tip of a screwdriver which is inserted into the receiver 19 so that then using the screwdriver the actuating element 4 can be moved out of the first position into the second position, or vice versa. Due to the shape of the actuating element 4, which tapers down, each actuating element 4 can be easily inserted from overhead into the corresponding opening in the housing 2. It is possible for the actuating element 4 to be easily inserted even for a closed housing 2 so that the side wall 10 of the housing need not be removed for installation of the actuating elements 4.

Finally, in conjunction with FIG. 2, it is apparent that the actuating elements 4 are made and arranged in the housing 2 such that visual differentiation of the insertion position from the contact position is easily possible. In the actuating element 4 shown in FIG. 2 on the left and which is in the insertion position, the top edge 20 of the actuating element 4 projects distinctly over the top edge of the housing 2. In contrast, for the actuating element 4 which is shown in FIG. 2 on the right and which is locked in the contact position, the top edge 20 of the actuating element 4 is flush with the top edge of the housing 2. Thus, the electrician can also easily visually recognize the respective position of the actuating element 4.

What is claimed is:

1. An electrical terminal, comprising:

a housing including at least one side wall that has two elongated holes, the two elongated holes being positioned on a common circular path, spaced apart from one another;

a busbar;

at least two insulation piercing elements;

a conductor receiver to receive conductors to be connected; and at least two actuating elements;

wherein the insulation piercing elements produce electrical contact between an inserted conductor and the busbar;

wherein the actuating elements are arranged so as to turn relative to the insulation piercing elements in the electrical terminal, the actuating elements, each further comprising:

two journals, each journal being located in a corresponding one of the elongated holes and being restricted so that the actuating element, when pivoted out of a first position in which the insertion of an incoming conductor is possible into a second position in which the conductor makes contact with the insulation piercing element, is guided and restricted by the movement of the journals within the elongated holes.

2. The electrical terminal as claimed in claim 1, wherein lengthwise axes of the two elongated holes are roughly perpendicular to one another.

3. The electrical terminal as claimed in claim 1, further comprising:

a recess located in each of the actuating elements; and ribs located within the housing, so that upon pivoting of the actuating elements out of the first position and into the second position, a rib moves into each recess.

4. The electrical terminal as claimed in claim 3, wherein a radial projection is formed on the end face of the actuating element above the recess and is supported on a rib when the actuating element is pivoted out of the first position into the second position.

5. The electrical terminal as claimed in claim 3, wherein, in the second position of the actuating element, an inserted conductor is clamped or fixed by the rib to provide tension relief for an inserted conductor.

6. The electrical terminal as claimed in claim 3, wherein the ribs are located in the housing above the insulation piercing elements.

7. The electrical terminal as claimed in claim 1, wherein the actuating elements are locked in the first position and in the second position.

8. The electrical terminal as claimed in claim 7, further comprising:

a set of ribs formed in the upper area of the actuating element and with the upper edge of the housing form a two-stage catch.

9. The electrical terminal as claimed in claim 1, wherein the conductor receiver is an elongated hole, and wherein the elongated hole extends into a receiving pocket which is located underneath the insulation piercing element.

10. The electrical terminal as claimed in claim 9, wherein the conductor receiver has a side that is open lengthwise.

11. The electrical terminal as claimed in claim 1, wherein the actuating elements have a tapered shape so that the actuating elements can be inserted into openings in the housing of the terminal.

12. The electrical terminal as claimed in claim 1, wherein the actuating elements further comprise:

a receiver for engaging an aid, wherein the electrical terminal can be guided out of the first position and into the second position with use of the aid.

13. The electrical terminal as claimed in claim 1, wherein a top edge of the actuating element, in the first position, projects over the upper edge of the housing.

* * * * *